US006868977B2

(12) United States Patent
Rosenbauer et al.

(10) Patent No.: US 6,868,977 B2
(45) Date of Patent: Mar. 22, 2005

(54) ADAPTER FOR A DISH BASKET OF A DISHWASHER

(75) Inventors: Michael Rosenbauer, Reimlingen (DE); Heinz Heissler, Dillingen (DE); Ulrich Deiss, Sontheim (DE); Gerhard Fetzer, Gundelfingen (DE)

(73) Assignee: BSH Bosch und Siemens Hausgerate GmbH, Munich (DE)

( * ) Notice: Subject to any disclaimer, the term of this patent is extended or adjusted under 35 U.S.C. 154(b) by 0 days.

(21) Appl. No.: 10/437,865

(22) Filed: May 13, 2003

(65) Prior Publication Data

US 2004/0020876 A1 Feb. 5, 2004

(30) Foreign Application Priority Data

Nov. 15, 2000 (DE) ..... 100 56 487

(51) Int. Cl.[7] ..... A47G 19/08
(52) U.S. Cl. ..... 211/41.9; 211/183; 211/181.1
(58) Field of Search ..... D32/2, 3; 211/41.9, 211/41.4, 41.8, 181.1; 134/137, 25.2, 201, 85; 108/901

(56) References Cited

U.S. PATENT DOCUMENTS 3,182,854 A * 5/1965 Geller ..... 220/676
3,288,155 A * 11/1966 Swetnam ..... 134/176
3,842,768 A * 10/1974 Maistre ..... 114/312
4,133,270 A * 1/1979 Ravera ..... 108/57.25
5,307,931 A * 5/1994 Gillispie et al. ..... 206/386
5,392,911 A * 2/1995 Gillispie et al. ..... 206/386
6,290,191 B1 * 9/2001 Hendricks et al. ..... 248/188.1
6,352,622 B1 * 3/2002 Brown et al. ..... 204/242

FOREIGN PATENT DOCUMENTS

| | | | | |
|---|---|---|---|---|
| DE | 7605749 | | 2/1976 | |
| DE | 8437945 | U1 | 1/1989 | |
| EP | 0966913 | A2 | 12/1999 | |
| EP | 0 966 913 | * | 12/1999 | ..... A47L/15/00 |
| GB | 2198032 | A | 6/1988 | |
| WO | WO 8900022 | A | 1/1989 | |
| WO | WO 89 00022 | * | 1/1989 | ..... A47L/15/50 |

* cited by examiner

*Primary Examiner*—Carl D. Friedman
*Assistant Examiner*—Jennifer E. Novosad
(74) *Attorney, Agent, or Firm*—John T. Winburn; Russell W. Warnock; Craig J. Loest

(57) ABSTRACT

An insert having openings for the penetration of dish washing liquid, limited by ridges in-plane crossing at crossing points, ridges are embodied according to the invention at the crossing points in such a sloped manner, that they are provided with a rhomb shaped cross-section. Due to the rhomb shaped profile of the ridges embodied in a sloped manner a type of double pyramid is formed, by which the dish washing liquid can autonomously run off downwards over the sloped planes provided on all sides of the rhombus, particularly in the critical locations.

11 Claims, 1 Drawing Sheet

ADAPTER FOR A DISH BASKET OF A DISHWASHER

Figure 1:
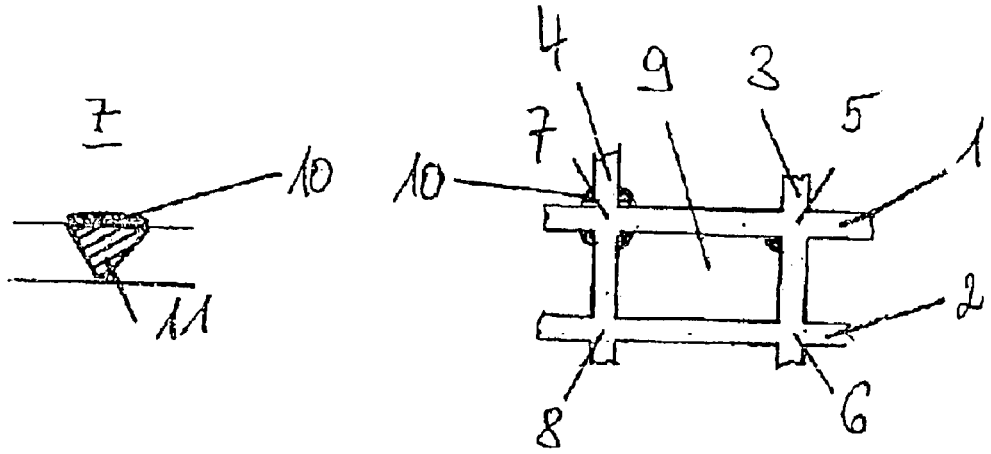

The invention relates to an insert for a dish basket for an automatic dish washer according to the preamble of claim 1.

From the German patent DE 36 41 020 an insert is known for a dish basket of an automatic dish washer for cleaning and drying silverware pieces and small dishes. Here, at least one dish basket is provided with a silverware basket, that can be inserted therein and has openings for the penetration of dish washing liquid both in the floor of the silverware basket and the walls of the silverware basket. Additionally, a tray is provided having additional openings for silverware that can be hung and/or fasteners and/or retainers for small dishes, which can be inserted into the floor of the dish basket or can be positioned in a lid-like manner onto the silverware basket. The openings arranged in the side walls, the floor, and the cover of the silverware basket and/or the tray are each limited by straight ridges in-plane crossing one another at a right angle.

From the German utility patent DE 76 05 749 a silverware basket is known, in which the ridges limiting the openings in the floor of the silverware basket are provided with ridge sections extending in a sloped manner. These ridge sections originate in the level of the floor of the silverware basket and unite outside of this level. The advantage of this silverware basket, which can be produced with difficulty only, compared to the horizontally extending ridges is an improved drop run-off off the floor of the silverware basket.

From the German publication DE 198 20 979 a silverware tray for automatic dish washers is known provided with ridges coupled with one another at higher and lower positions in a pyramid-like fashion. In the German publications 195 40 610 and 195 40 611 trays are described, also called etageres, for dish baskets in an automatic dish washer, each of which may be mounted firmly or movably to the dish basket and/or arranged loosely as an insert for cleaning and drying of silverware pieces and/or small dishes.

The profiles of the ridges of conventional solutions are all provided with the disadvantage that, particularly, on a horizontal plane, frequently residual dish washing liquid remains that does not runoff autonomously but must be dried. Contacting silverware pieces are frequently still wet at the shaft even after the drying phase of the cleaning program. Additionally, silverware baskets and/or other inserts are disadvantageously wet to a larger extend in the corners of the individual rectangular shaped perforations or openings, where usually the silverware pieces contact, i.e., there are numerous "contact points" for the dish washing liquid that aggravate the drying process and/or extend the drying phase and lead to the formation of drying spots on the silverware pieces.

The invention is based on the object to provide a use of the type described by which the result of the drying process can be improved compared to the solutions known.

This object is attained according to the invention in the characteristics of claim 1. Further embodiments of the invention are mentioned in the dependent claims.

Based on an insert having openings for the penetration of dish washing liquid, limited by ridges in plane crossing one another at crossing points, the ridges according to the object of the invention are embodied in a sloped manner that they are each provided with a rhomb shaped cross-section. Due to the rhomb shaped profile of the ridges embodied in a sloped manner a sort of double pyramid develops at the crossing points. Caused by the rhomb shaped profile and the profile in the form of a double pyramid created at the crossing points the dish washing liquid can run off autonomously, particularly at the critical points, via the sloped planes existing on all sides of the rhombus and/or the double pyramid. This prevents any residual dish washing liquid on the horizontal planes and the numerous contact points, particularly at the crossing points. Overall, the insert designed according to the invention leads to essentially improved drying results for the pieces loaded in the insert compared to conventional solutions, in particular, for the silverware pieces and/or small dishes. The disadvantageous, increased wetting of numerous contact points in the conventional inserts and, particularly, in the corners of the individual perforations and openings is reduced by the sloped ridges embodied with a rhomb shaped cross-section according to the invention, which improves the drying process, shortens the drying phase, and inhibits the development of drying spots on the silverware pieces.

According to another particularly beneficial embodiment of the invention the openings of the insert are embodied in a rounded fashion by radiuses each in the region of the crossing points. Therefore, the dish washing liquid can better run off the openings rounded in the "corners", which advantageously accelerates the drying during the drying process, particularly of silverware pieces and/or small dishes usually contacting the "corners" of the openings.

According to another embodiment of the invention the sloped ridges, embodied at the crossing points and having a rhomb shaped cross-section, preferably form the floor of a silverware basket and/or the lid of a silverware basket and/or the side walls of a silverware basket, which can be loaded with silverware pieces and/or small dishes. The sloped ridges embodied at the crossing points, that have a rhomb shaped cross-section, may also form a tray, the etagere, that can be loaded with silverware pieces and/or small dishes.

The object of the invention is explained in greater detail using the exemplary embodiment shown in the figures. They show in detail FIG. 1 a section of an insert of common structure with a cross-section of the ridges at the crossing points.

Figure 2:
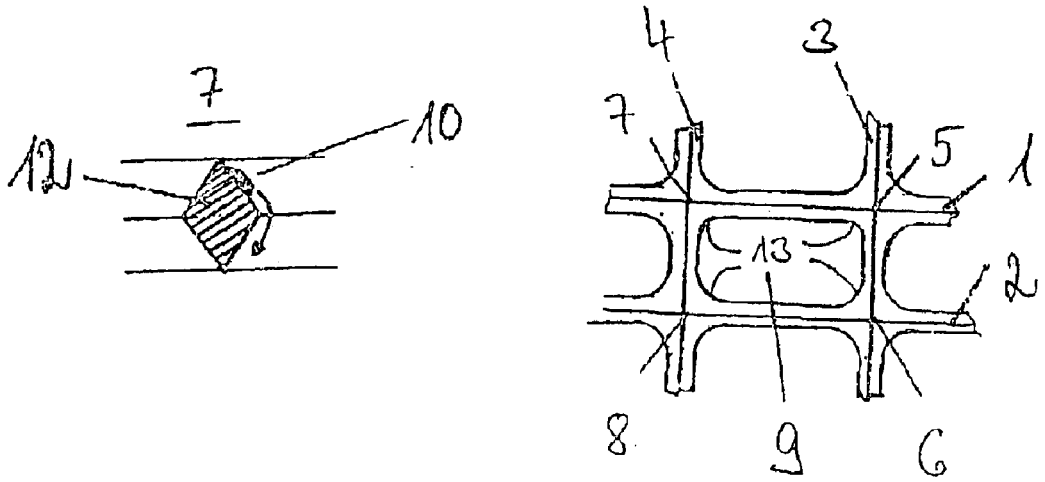

FIG. 2 the section of the insert according to FIG. 1 with a cross-section of the ridges embodied according to the object of the invention.

FIG. 1 and FIG. 2 show only one section of the insert, sufficient for demonstrating the principle of the invention though, which, for example, may be loosely arranged in a dish basket as a silverware basket for being loaded with silverware pieces and/or small dishes in an automatic dish washer and/or mounted firmly or movably. The elementary structure of a silverware basket having side walls, a floor and/or a lid is equivalent to the insert described in the German patent DE 36 41 020. The use of the insert according to the invention is also possible in the form of a tray, an étagère, that can be loaded with silverware pieces and/or small dishes.

The section of the insert according to prior art in FIG. 1 includes two ridges 1 and 2 extending longitudinally and two ridges 3 and 4 extending laterally, which both may form the side walls of the insert as well as the floor of the silverware basket and/or the lid of the silverware basket. Here, the ridges 1 and 2 cross the ridges 3 and 4 in four crossing points 5, 6, 7, and 8 and, thus, limit the perforation 9 forming an opening for the penetration of dish washing liquid.

The ridges 1 through 4 crossing are each embodied at the crossing points 5 through 8, of which FIG. 1 shows the crossing point 7 as an example in the view of a cross-section and/or of its profile, preferably sloped downward like a cone 11, in order to improve the drying result for the silverware pieces and/or the small dishes in reference to conventional inserts having ridges extending straight. However, FIG. 1 shows existing problem areas, at which residual dish washing liquid 10 remains in spite of the sloped ridges and cannot run-off autonomously. These are primarily the horizontal planes of the container and the corners of the individual openings 9, in which the silverware basket are increasingly wet and which the pieces contact.

Therefore, as shown in FIG. 2, the ridges 1 through 4 are embodied in a sloped fashion according to the invention such, that they are provided each with a rhomb shaped cross-section having a profile shaped in the manner of a double pyramid 12 at the crossing points 5 through 8, of which only the crossing point 7 is shown here as an example in the view of a cross-section and/or a profile. This results in the optimization of the drying result and the duration of the drying phase, by way of pulling the dish washing liquid 10 downward over all sloped planes of the rhombus, indicated by the arrow, i.e., by the dish washing liquid 10 running-off autonomously. The improved drying is additionally enhanced by the opening 9, shown as a representation of the design of all other openings of the silverware basket, and being rounded by the radiuses 13 each embodied in the region of the crossing points 5 through 8. The contact points in the "corriers" wet with dish washing liquid, are no longer present for the run-off downward, and the silverware pieces and/or small dishes contacting the silverware basket can dry more rapidly. The quick and autonomous sliding off of dish washing liquid 10, due to the sloped ridges 1 through 4, having a rhomb shaped cross-section, and the reduction of the contact points, due to the rounded openings, not only optimize the drying performance but also advantageously improve the cleaning performance of the rinsing and drying program of an automatic dish washer, and inhibit the formation of drying spots on the silverware pieces.

What is claimed is:

1. An insert for a dish basket in an automatic dish washer, said insert comprising:

a body structure including a plurality of openings for the penetration of a dish washing liquid;

said openings formed by a plurality of ridges crossing substantially in a plane at a plurality of crossing points, said crossing points including rounded radiuses forming substantially rounded corners in said openings; and said ridges formed in a structure having a substantially rhomb shaped cross-section.

2. The insert according to claim 1, including said rhomb shaped cross-sections of said ridges at said crossing points form a substantially double pyramid shape.

3. The insert according to claim 1, including said dish basket being a silverware basket which is adapted to be loaded with at least one of a plurality of silverware pieces and dishes or other objects and said openings formed by said plurality of ridges crossing substantially in a plane at a plurality of crossing points adapted to form at least one of the floor, side walls and lid of said basket.

4. The insert according to claim 1, including said plurality of ridges crossing substantially in a plane at a plurality of crossing points forming said openings form a tray which is adapted to be loaded with at least one of a plurality of silverware pieces and dishes or other objects.

5. The insert according to claim 1, including said insert body structure adapted to be mounted fixedly or removably to the dish basket.

6. The insert according to claim 1, including said insert body structure adapted to be mounted loosely to the dish basket.

7. An insert for a dish basket in an automatic dish washer, said insert comprising:

a body structure including a plurality of openings for the penetration of a dish washing liquid;

said openings formed by a plurality of ridges crossing substantially in a plane at a plurality of crossing points;

said ridges formed in a structure having a substantially rhomb shaped cross-section and said rhomb shaped cross-sections of said ridges at said crossing points form a substantially double pyramid shape; and said crossing points including rounded radiuses forming substantially rounded corners in said openings.

8. The insert according to claim 7, including said dish basket being a silverware basket which is adapted to be loaded with at least one of a plurality of silverware pieces and dishes or other objects and said openings formed by said plurality of ridges crossing substantially in a plane at a plurality of crossing points adapted to form at least one of the floor, side walls and lid of said basket.

9. The insert according to claim 7, including said plurality of ridges crossing substantially in a plane at a plurality of crossing points forming said openings form a tray which is adapted to be loaded with at least one of a plurality of silverware pieces and dishes or other objects.

10. The insert according to claim 7, including said insert body structure adapted to be mounted fixedly or removably to the dish basket.

11. The insert according to claim 7, including said insert body structure adapted to be mounted loosely to the dish basket.

* * * * *

UNITED STATES PATENT AND TRADEMARK OFFICE

CERTIFICATE OF CORRECTION

PATENT NO. : 6,868,977 B2
APPLICATION NO. : 10/437865
DATED : March 22, 2005
INVENTOR(S) : Michael Rosenbauer et al.

It is certified that error appears in the above-identified patent and that said Letters Patent is hereby corrected as shown below:

Title Page, Insert:

Related U.S. Application Data Item

(63) Continuation of Application No. PCT/EP01/12999, filed Nov. 9, 2001.

Signed and Sealed this

Third Day of April, 2007

JON W. DUDAS
*Director of the United States Patent and Trademark Office*